US011124902B2

(12) United States Patent
Llop et al.

(10) Patent No.: US 11,124,902 B2
(45) Date of Patent: Sep. 21, 2021

(54) POLYETHYLENE COMPOSITIONS FOR THE PREPARATION OF TAPES, FIBERS, OR MONOFILAMENTS

(71) Applicant: Dow Global Technologies LLC, Midland, MI (US)

(72) Inventors: Cosme Llop, Barcelona (ES); Maria Isabel Arroyo Villan, Tarragona (ES)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/766,156

(22) PCT Filed: Nov. 7, 2016

(86) PCT No.: PCT/US2016/060771
§ 371 (c)(1),
(2) Date: Apr. 5, 2018

(87) PCT Pub. No.: WO2017/099915
PCT Pub. Date: Jun. 15, 2017

(65) Prior Publication Data

US 2018/0298524 A1 Oct. 18, 2018

Related U.S. Application Data

(60) Provisional application No. 62/265,442, filed on Dec. 10, 2015.

(51) Int. Cl.
*D01F 6/04* (2006.01)
*D01F 6/30* (2006.01)

(52) U.S. Cl.
CPC ..... *D01F 6/04* (2013.01); *D01F 6/30* (2013.01); *D10B 2321/021* (2013.01); *D10B 2401/04* (2013.01)

(58) Field of Classification Search
None
See application file for complete search history.

(56) References Cited

U.S. PATENT DOCUMENTS

| | | | | |
|---|---|---|---|---|
| 4,100,105 | A | 7/1978 | Levine et al. | |
| 6,022,933 | A | 2/2000 | Wright et al. | |
| 8,802,802 | B2 | 8/2014 | Breese | |
| 2005/0175803 | A1 | 8/2005 | Breese | |
| 2005/0287359 | A1 | 12/2005 | Breese | |
| 2009/0246433 | A1 | 10/2009 | Michie et al. | |
| 2011/0092937 | A1 | 4/2011 | Pepper | |
| 2012/0204322 | A1* | 8/2012 | Fukushima | D01D 5/247 2/167 |
| 2013/0029552 | A1* | 1/2013 | Fukushima | D01F 6/04 442/181 |
| 2013/0190465 | A1 | 7/2013 | Demirors et al. | |
| 2013/0216736 | A1 | 8/2013 | Sandkuehler et al. | |

FOREIGN PATENT DOCUMENTS

| | | | |
|---|---|---|---|
| EP | 2137344 | * | 4/2015 |
| JP | 5727615 | * | 10/2013 |
| WO | 01/05852 | A1 | 1/2001 |
| WO | 2004/094489 | A1 | 11/2004 |
| WO | 2008/001927 | A3 | 3/2008 |

OTHER PUBLICATIONS

Machine translation of JP5727615 (Year: 2013).*
PCT/US2016/060771, International Search Report and Written Opinion dated Feb. 10, 2017.
PCT/US2016/060771, International Preliminary Report on Patentability dated Jun. 12, 2018.

* cited by examiner

*Primary Examiner* — Shawn Mckinnon

(57) ABSTRACT

A polyethylene tape, fiber, or monofilament comprising an ethylene/alpha-olefin polymer having a density greater than 0.945 g/cc, a melt index, $I_{2.16}$, from 1.2 g/10 min to 2.0 g/10 min, a melt flow ratio, $I_{10}/I_{2.16}$, between 7.0 and 9.0, and a molecular weight distribution, Mw/Mn, of less than 5.5.

6 Claims, No Drawings

POLYETHYLENE COMPOSITIONS FOR THE PREPARATION OF TAPES, FIBERS, OR MONOFILAMENTS

TECHNICAL FIELD

Embodiments of the present disclosure generally relate to polyethylene compositions, and more particularly to polyethylene compositions for the preparation of tapes, fibers, or monofilaments.

BACKGROUND

Polyethylene used for the fabrication of tapes, fibers, and monofilament may need to have high residual tensile energy to allow for processing of the tape, fiber or monofilament into a fabricated article. Previous polyethylene resins that have been used include high density polyethylene. However, the high density polyethylene does not typically have good processability. This can result in a lower output and/or high energy consumption.

Accordingly, it may be desirable to produce polyethylene compositions having improved processability and residual tensile energy after machine direction orientation.

SUMMARY

Disclosed in embodiments herein are polyethylene tapes, fibers, or monofilaments. The tapes, fibers, or monofilaments comprise an ethylene/alpha-olefin polymer having a density greater than 0.945 g/cc, a melt index, $I_{2.16}$, from 1.2 g/10 min to 2.0 g/10 min, a melt flow ratio, $I_{10}/I_{2.16}$, between 7.0 and 9.0, and a molecular weight distribution, Mw/Mn, of less than 5.5.

Also disclosed in embodiments herein are knitted articles. The knitted articles are formed from a machine direction-oriented polyethylene tape, fiber, or monofilament. The tapes, fibers, or monofilaments comprise an ethylene/alpha-olefin polymer having a density greater than 0.945 g/cc, a melt index, $I_{2.16}$, from 1.2 g/10 min to 2.0 g/10 min, a melt flow ratio, $I_{10}/I_{2.16}$, between 7.0 and 9.0, and a molecular weight distribution, Mw/Mn, of less than 5.5.

Also disclosed in embodiments herein are woven articles. The woven articles are formed from a machine direction-oriented polyethylene tape, fiber, or monofilament. The tapes, fibers, or monofilaments comprise an ethylene/alpha-olefin polymer having a density greater than 0.945 g/cc, a melt index, $I_{2.16}$, from 1.2 g/10 min to 2.0 g/10 min, a melt flow ratio, $I_{10}/I_{2.16}$, between 7.0 and 9.0, and a molecular weight distribution, Mw/Mn, of less than 5.5.

Additional features and advantages of the embodiments will be set forth in the detailed description which follows, and in part will be readily apparent to those skilled in the art from that description or recognized by practicing the embodiments described herein, including the detailed description which follows, the claims. It is to be understood that both the foregoing and the following description describe various embodiments and are intended to provide an overview or framework for understanding the nature and character of the claimed subject matter.

DETAILED DESCRIPTION

Reference will now be made in detail to embodiments of tapes, fibers, or monofilaments. The tapes, fibers, or monofilaments may be used to form woven or knitted structures. Examples may be sheeting, drapes, disposable clothing, protective clothing, outdoor fabrics, industrial fabrics, netting, bagging, rope, cordage and other fibrous products. It is noted, however, that this is merely an illustrative implementation of the embodiments described herein. The embodiments are applicable to other technologies that are susceptible to similar problems as those discussed above. For example, the polyethylene compositions described herein may be used in nonwoven or composite fibrous structures.

The tapes, fibers, or monofilaments comprise an ethylene/alpha-olefin polymer. The ethylene/alpha-olefin polymer comprises (a) less than or equal to 100 percent, for example, at least 80 percent, or at least 90 percent, of the units derived from ethylene; and (b) less than 20 percent, for example, less than 15 percent, less than 10 percent, less than 5 percent, or less than 3 percent, by weight of units derived from one or more alpha-olefin comonomers. The term "ethylene/alpha-olefin polymer" refers to a polymer that contains more than 50 mole percent polymerized ethylene monomer (based on the total amount of polymerizable monomers) and at least one comonomer.

The alpha-olefin comonomers have no more than 20 carbon atoms. For example, in some embodiments, the alpha-olefin comonomer is a $C_3$-$C_{10}$ alpha-olefin, $C_4$-$C_{10}$ alpha-olefin, or a $C_4$-$C_8$ alpha-olefin. Exemplary alpha-olefin comonomers include, but are not limited to, propylene, 1-butene, 1-pentene, 1-hexene, 1-heptene, 1-octene, 1-nonene, 1-decene, and 4-methyl-1-pentene. The one or more alpha-olefin comonomers may, for example, be selected from the group consisting of propylene, butene, hexene, and octene; or in the alternative, from the group consisting of butene, hexene, and octene; or in the alternative, from the group consisting of hexene and octene.

Any conventional polymerization processes may be employed to produce the ethylene/alpha-olefin polymer. Such conventional polymerization processes include, but are not limited to, solution polymerization process, using one or more conventional reactors e.g. loop reactors, isothermal reactors, stirred tank reactors, batch reactors in parallel, series, and/or any combinations thereof. In some embodiments, the ethylene/alpha-olefin polymer may, for example, be produced via solution phase polymerization process using one or more loop reactors, isothermal reactors, and combinations thereof.

In general, the solution phase polymerization process may occur in one or more well-stirred reactors, such as, one or more loop reactors or one or more spherical isothermal reactors at a temperature in the range of from 115 to 250° C.; for example, from 150 to 200° C., and at pressures in the range of from 300 to 1000 psi; for example, from 400 to 750 psi. In one embodiment in a dual reactor, the temperature in the first reactor temperature is in the range of from 115 to 190° C., for example, from 115 to 150° C., and the second reactor temperature is in the range of 150 to 200° C., for example, from 170 to 195° C. In another embodiment in a single reactor, the temperature in the reactor temperature is in the range of from 150 to 250° C., for example, from 160 to 200° C. The residence time in a solution phase polymerization process may range from 2 to 30 minutes; for example, from 10 to 20 minutes. Ethylene, solvent, one or more catalyst systems, optionally, one or more cocatalysts, and optionally, one or more comonomers are fed continuously to one or more reactors. Exemplary solvents include, but are not limited to, isoparaffins. For example, such solvents are commercially available under the name ISOPAR E from ExxonMobil Chemical Co., Houston, Tex. The resultant mixture of the ethylene/alpha-olefin polymer and solvent is then removed from the reactor and the ethylene/alpha-olefin polymer is isolated. Solvent is typically recovered via a solvent recovery unit, i.e. heat exchangers and vapor liquid separator drum, and is then recycled back into the polymerization system.

In embodiments herein, the ethylene/alpha-olefin polymer is a heterogeneously branched ethylene/alpha-olefin polymer. Heterogeneously branched interpolymers may be produced by Ziegler-Natta type catalysts or chromium-based catalysts, and contain a non-homogeneous distribution of comonomer among the molecules of the polymer. In some embodiments, the ethylene/alpha-olefin polymer is made in the presence of one or more Ziegler-Natta catalyst systems. In other embodiments, the ethylene/alpha-olefin polymer may be polymerized using chromium-based catalysts. Suitable methods to polymerize ethylene monomers using chromium-based catalysts are generally known in the art, and may include gas-phase, solution phase and slurry-phase polymerization processes.

In some embodiments, the ethylene/alpha-olefin polymer is made in a solution reactor. The ethylene/alpha-olefin polymer may be polymerized in a solution-phase process, using a multi-constituent catalyst system. The multi-constituent catalyst system, as used herein, refers to a Ziegler-Natta catalyst composition including a magnesium and titanium containing procatalyst and a cocatalyst. The procatalyst may, for example, comprise the reaction product of magnesium dichloride, an alkylaluminum dihalide, and a titanium alkoxide.

The olefin polymerization procatalyst precursors comprise the product which results from combining: (A) a magnesium halide prepared by contacting: (1) at least one hydrocarbon soluble magnesium component represented by the general formula R"R'Mg.xAlR'3 wherein each R" and R' are alkyl groups; and (2) at least one non-metallic or metallic halide source under conditions such that the reaction temperature does not exceed about 60° C., in some embodiments, does not exceed about 40° C., and in other embodiments, does not exceed about 35° C.; (B) at least one transition metal compound represented by the formula Tm(OR)y Xy-x wherein Tm is a metal of Groups IVB, VB, VIB, VIIB or VIII of the Periodic Table; R is a hydrocarbyl group having from 1 to about 20, and in some embodiments from 1 to about 10 carbon atoms; (C) an additional halide source if an insufficient quantity of component (A-2) is present to provide the desired excess X:Mg ratio.

Particularly suitable transition metal compounds include, for example, titanium tetrachloride, titanium trichloride, vanadium tetrachloride, zirconium tetrachloride, tetra(isopropoxy)-titanium, tetrabutoxytitanium, diethoxytitanium dibromide, dibutoxytitanium dichloride, tetraphenoxytitanium, tri-isopropoxy vanadium oxide, zirconium tetra-n-propoxide, mixtures thereof and the like.

Other suitable titanium compounds which can be employed as the transition metal component herein include those titanium complexes and/or compounds resulting from reacting: (A) at least one titanium compound represented by the formula Ti(OR)x X4-x wherein each R is independently a hydrocarbyl group having from 1 to about 20, from about 1 to about 10, or from about 2 to about 4 carbon atoms; X is a halogen and x has a value from zero to 4; with (B) at least one compound containing at least one aromatic hydroxyl group. The foregoing procatalyst components are combined in proportions sufficient to provide atomic ratios as previously mentioned.

The pro-catalytic reaction product may be prepared in the presence of an inert diluent. The concentrations of catalyst components may be such that when the essential components of the catalytic reaction product are combined, the resultant slurry is from about 0.005 to about 1.0 molar (moles/liter) with respect to magnesium. By way of example, suitable inert organic diluents can include liquefied ethane, propane, isobutane, n-butane, n-hexane, the various isomeric hexanes, isooctane, paraffinic mixtures of alkanes having from 8 to 12 carbon atoms, cyclohexane, methylcyclopentane, dimethylcyclohexane, dodecane, industrial solvents composed of saturated or aromatic hydrocarbons such as kerosene, naphthas, etc., especially when freed of any olefin compounds and other impurities, and especially those having boiling points in the range from about −50° C. to about 200° C. Mixing of the procatalyst components to provide the desired catalytic reaction product is advantageously prepared under an inert atmosphere such as nitrogen, argon or other inert gas at temperatures in the range from about −100° C. to about 200° C., preferably from about −20° C. to about 100° C., provided that the magnesium halide support is prepared such that the reaction temperature does not exceed about 60° C. In the preparation of the catalytic reaction product, it is not necessary to separate hydrocarbon soluble components from hydrocarbon insoluble components of the reaction product.

The procatalyst composition serves as one component of a Ziegler-Natta catalyst composition, in combination with a cocatalyst. The cocatalyst is employed in a molar ratio based on titanium in the procatalyst of from 1:1 to 100:1, and, in some embodiments, in a molar ratio of from 1:1 to 5:1. In some embodiments, the cocatalyst may be triethylaluminum. Ziegler-Natta catalysts and polymerization methods are further described in EP2218751, WO2004/094489, U.S. Pat. No. 4,100,105, and U.S. Pat. No. 6,022,933, which are incorporated herein in its entirety by reference. Trace amounts of impurities, for example, catalyst residues, may be incorporated into and/or within a polymer.

In embodiments herein, the density of the ethylene/alpha-olefin polymer is greater than 0.945 g/cc. All individual values and subranges of greater than 0.945 g/cc are included and disclosed herein. For example, in some embodiments, the density of the ethylene/alpha-olefin polymer is from 0.946 to 0.965 g/cc. In other embodiments, the density of ethylene/alpha-olefin polymer is from 0.946 to 0.960 g/cc. In further embodiments, the density of the ethylene/alpha-olefin polymer is from 0.946 to less than 0.955 g/cc. Densities disclosed herein for ethylene-based polymers are determined according to ASTM D-792.

In embodiments herein, the melt index, or $I_{2.16}$, of the ethylene/alpha-olefin polymer is from 1.2 g/10 min to 2.0 g/10 min. All individual values and subranges of 1.2 g/10 min to 2.0 g/10 min are included and disclosed herein. For example, in some embodiments, the melt index of the ethylene/alpha-olefin polymer is 1.4 g/10 min to 2.0 g/10 min. In other embodiments, the melt index of the ethylene/alpha-olefin polymer is 1.2 g/10 min to 1.8 g/10 min. In further embodiments, the melt index of the ethylene/alpha-olefin polymer is 1.4 g/10 min to 1.7 g/10 min Melt index, or $I_{2.16}$, for ethylene-based polymers is determined according to ASTM D1238 at 190° C., 2.16 kg.

In embodiments herein, the ethylene/alpha-olefin polymer may have a melt flow ratio, $I_{10}/I_{2.16}$, of from 7.0 to 9.0. All individual values and subranges of 7.0 to 9.0 are included and disclosed herein. For example, in some embodiments, the ethylene/alpha-olefin polymer may have a melt flow ratio, $I_{10}/I_{2.16}$, of from 7.2 to 9.0. In other embodiments, the ethylene/alpha-olefin polymer may have a melt flow ratio, $I_{10}/I_{2.16}$, of from 7.2 to 8.8. In further embodiments, the ethylene/alpha-olefin polymer may have a melt flow ratio, $I_{10}/I_{2.16}$, of from 7.2 to 8.6. In even further embodiments, the ethylene/alpha-olefin polymer may have a melt flow ratio, $I_{10}/I_{2.16}$, of from 7.2 to 8.4. Melt index, or $I_{10}$, for ethylene-based polymers is determined according to ASTM D1238 at 190° C., 10.0 kg.

In embodiments herein, the ethylene/alpha-olefin polymer may have a molecular weight distribution ($M_w/M_n$, where $M_w$ is the weight average molecular weight and $M_n$ is number average molecular weight, both of which are measured by gel permeation chromatography), of less than 5.5. All individual values and subranges of less than 5.5 are included and disclosed herein. For example, in some embodiments, the ethylene/alpha-olefin polymer may have a molecular weight distribution ($M_w/M_n$) of less than or equal to 5.2, less than or equal to 5.0, less than or equal to 4.7, less than or equal to 4.5, or less than or equal to 4.2. In other embodiments, the ethylene/alpha-olefin polymer may have a molecular weight distribution ($M_w/M_n$) of from 3.0 to 5.5, 3.0 to 5.2, or 3.0 to 5.0. In further embodiments, the ethylene/alpha-olefin polymer may have a molecular weight distribution ($M_w/M_n$) of from 3.2 to 5.5, 3.2 to 5.2, 3.2 to 5.0, 3.2 to 4.7, 3.2 to 4.5, or 3.2 to 4.2.

In embodiments herein, the ethylene/alpha-olefin polymer has a unimodal molecular weight distribution as determined by gel permeation chromatography. For example, the ethylene/alpha-olefin polymer may have a unimodal molecular weight distribution of less than 5.5. All individual values and subranges of less than 5.5 are included and disclosed herein. For example, in some embodiments, the ethylene/alpha-olefin polymer may have a unimodal molecular weight distribution of less than 5.2, less than 5.0, less than 4.7, less than 4.5, less than 4.2, or less than 4.0. In other embodiments, the ethylene/alpha-olefin polymer may have a unimodal molecular weight distribution ($M_w/M_n$) of from 3.0 to 5.5, 3.0 to 5.2, or 3.0 to 5.0. In further embodiments, the ethylene/alpha-olefin polymer may have a unimodal molecular weight distribution ($M_w/M_n$) of from 3.2 to 5.5, 3.2 to 5.2, 3.2 to 5.0, 3.2 to 4.7, 3.2 to 4.5, or 3.2 to 4.2.

In embodiments herein, the ethylene/alpha-olefin polymer may further include one or more additives. Nonlimiting examples of suitable additives include antioxidants, pigments, colorants, UV stabilizers, UV absorbers, curing agents, cross linking co-agents, boosters and retardants, processing aids, fillers, coupling agents, ultraviolet absorbers or stabilizers, antistatic agents, nucleating agents, slip agents, plasticizers, lubricants, viscosity control agents, tackifiers, anti-blocking agents, surfactants, extender oils, acid scavengers, and metal deactivators. Additives can be used in amounts ranging from less than about 0.001 wt % to more than about 10 wt % based on the weight of the ethylene/alpha-olefin polymer.

Articles

In embodiments herein, the ethylene/alpha-olefin polymer is used to form a polyethylene tape, fiber, or monofilament may be formed according to any method known in the art. As used herein the polyethylene tape, fiber, or monofilament refers to a tape, fiber, or monofilament that is made from 100% polyethylene out of the total polymer content. "Polyethylene" refers to polymers comprising greater than 50% by weight of units which have been derived from ethylene monomer. This includes polyethylene homopolymers or copolymers (meaning units derived from two or more comonomers). Common forms of polyethylene known in the art include low density polyethylene (LDPE); linear low density polyethylene (LLDPE); ultra low density polyethylene (ULDPE); very low density polyethylene (VLDPE); constrained geometry catalyzed (including metallocene and post metallocene catalysts) linear low density polyethylene, including both linear and substantially linear low density resins (m-LLDPE); and high density polyethylene (HDPE).

The tape, fiber, or monofilament may be formed by, for example, extrusion or melt-spinning. The tape, fiber, or monofilament may optionally undergo additional processing steps, such as, stretching, annealing, cutting, etc. The term tape, fiber, or monofilament may include a monofilament, a multifilament, a film, a fiber, a yarn, such as, for example, tape yarn, fibrillated tape yarn, or slit-film yarn, a continuous ribbon, and/or other stretched fibrous materials.

In embodiments herein, the tape may be machine direction oriented at a predetermined stretch ratio. For example, the stretch ratio may be at least 1:2, 1:3, 1:4, 1:5, 1:6, 1:7, or 1:8. In some embodiments, a tape that is machine direction oriented at a stretch ratio of at least 1:5 may exhibit the following properties: a young's modulus, as measured according to EN ISO 527-3, of greater than 2,500 MPa; and a tensile energy, as measured according to ASTM 527-3, of greater than 1.0 Joules.

In embodiments herein, a woven article, which can refer to the interlacing of two or more tapes, fibers, or monofilaments crossing each other, may be formed from a machine direction oriented polyethylene tape, fiber, or filament. In embodiments herein, a knitted article, which can refer to the interlocking of loops from one or more tape, fiber, or monofilaments, may be from a machine direction oriented polyethylene tape, fiber, or filament. As used herein, woven article and knitted articles can be used to form sheeting, drapes, disposable clothing, protective clothing, outdoor fabrics, industrial fabrics, netting, bagging, rope, cordage and other fibrous products. The tape, fiber, or filament comprises an ethylene/alpha-olefin polymer having a density greater than 0.945 g/cc; a melt index, $I_{2.16}$, from greater than 1.2 g/10 min to 2.0 g/10 min; a melt flow ratio, $I_{10}/I_{2.16}$, between 7.0 and 9.0; and a molecular weight distribution, $M_w/M_n$, of less than 5.5.

Test Methods

Unless otherwise stated, the following test methods are used. All test methods are current as of the filing date of this disclosure.

Density

Measurements are made according to ASTM D792, Method B.

Melt Index

Melt index, $I_{2.16}$, for ethylene-based polymers is determined according to ASTM D1238 at 190° C., 2.16 kg. Melt Index, $I_{10}$, for ethylene-based polymers is determined according to ASTM D1238 at 190° C., 10.0 kg.

Gel Permeation Chromatography

The chromatographic system consists of a PolymerChar HT-GPC-IR (Valencia, Spain) high temperature GPC chromatograph equipped with an internal IR4 detector. The autosampler oven compartment is set at 160° Celsius and the column compartment is set at 145° Celsius.

The columns are 4 Agilent PLgel "Mixed A," 20-micron particle columns, having a length of 200 mm and an internal diameter of 7.5 mm. The chromatographic solvent is 1,2,4 trichlorobenzene and contains 200 ppm of butylated hydroxytoluene (BHT). The solvent is stirred and degassed using an on-line solvent degasser from Agilent Technologies. The injection volume is 200 microliters and the flow rate is 1.0 milliliters/minute.

Calibration of the GPC column set is performed with 19 narrow molecular weight distribution polystyrene "EasiCal" PS-1 (A and B) and PS-2 (A and B) standards with molecular weights ranging from 580 to 7,500,000 obtained from Agilent Technologies using two standard spatulas are dissolved in 7 mL Solvent yielding approximately 10 mg/7 mL concentration. The polystyrene standards are dissolved at 160 degrees Celsius with gentle agitation for 60 minutes. The polystyrene standard peak molecular weights are converted to polyethylene molecular weights using Equation 1 (as described in Williams and Ward, J. Polym. Sci., Polym. Let., 6, 621 (1968)):

$$M_{polyethylene}=A\times(M_{polystyrene})^{B} \quad \text{(EQ1)}$$

where M is the molecular weight, A has a value of 0.4315 and B is equal to 1.0.

A fifth order polynomial is used to fit the respective polyethylene-equivalent calibration points. A small adjustment to A (from approximately 0.415 to 0.44) was made to correct for column resolution and band-broadening effects such that NIST standard NBS 1475 is obtained at 52,000 Mw.

The total plate count of the GPC column set is performed with Eicosane (prepared at 0.04 g in 50 milliliters of TCB and dissolved for 20 minutes with gentle agitation.) The plate count (Equation 2) and symmetry (Equation 3) are measured on a 200 microliter injection according to the following equations:

$$\text{Plate Count} = 5.54*\left(\frac{RV_{Peak\ Max}}{\text{Peak Width at } \frac{1}{2} \text{ height}}\right)^{2} \quad \text{(EQ2)}$$

where RV is the retention volume in milliliters, the peak width is in milliliters, the peak max is the maximum height of the peak, and ½ height is ½ height of the peak maximum.

$$\text{Symmetry}=\frac{(\text{Rear Peak } RV_{one\ tenth\ height}-RV_{Peak\ max})}{(RV_{Peak\ max}-\text{Front Peak } RV_{one\ tenth\ height})} \quad \text{(EQ3)}$$

where RV is the retention volume in milliliters and the peak width is in milliliters, Peak max is the maximum position of the peak, one tenth height is 1/10 height of the peak maximum, rear peak refers to the peak tail at later retention volumes than the peak max, and front peak refers to the peak front at earlier retention volumes than the peak max. The plate count for the chromatographic system should be greater than 24,000 and symmetry should be between 0.98 and 1.22.

Samples are prepared in a semi-automatic manner with the PolymerChar "Instrument Control" Software, wherein the samples are weight-targeted at 1.5 g/L, and the solvent (contained 200 ppm BHT) is added to a pre-nitrogen-sparged septa-capped vial, via the PolymerChar high temperature autosampler. The samples are dissolved for 2 hours at 160° Celsius under "low speed" shaking.

The calculations of Mn, Mw, and Mz are based on GPC results using the internal IR4 detector (measurement channel) of the PolymerChar HT-GPC-IR chromatograph according to Equations 4-6, using PolymerChar GPCOne™ software, the baseline-subtracted IR chromatogram at each equally-spaced data collection point (i), and the polyethylene equivalent molecular weight obtained from the narrow standard calibration curve for the point (i) from Equation 1.

$$M_n = \frac{\sum^{i} IR_i}{\sum^{i} (IR_i / M_{polyethylene_i})} \quad \text{(EQ4)}$$

-continued $$M_w = \frac{\sum^{i} (IR_i * M_{polyethylene_i})}{\sum^{i} IR_i} \quad \text{(EQ5)}$$

$$M_z = \frac{\sum^{i} (IR_i * M^2_{polyethylene_i})}{\sum^{i} (IR_i * M_{polyethylene_i})} \quad \text{(EQ6)}$$

In order to monitor the deviations over time, a flowrate marker (decane) is introduced into each sample via a micropump controlled with the PolymerChar HT-GPC-IR system. This flowrate marker is used to linearly correct the flowrate for each sample by alignment of the respective decane peak within the sample to that of the decane peak within the narrow standards calibration. Any changes in the time of the decane marker peak are then assumed to be related to a linear shift in both flowrate and chromatographic slope. To facilitate the highest accuracy of a RV measurement of the flow marker peak, a least-squares fitting routine is used to fit the peak of the flow marker concentration chromatogram to a quadratic equation. The first derivative of the quadratic equation is then used to solve for the true peak position. After calibrating the system based on a flow marker peak, the effective flowrate (as a measurement of the calibration slope) is calculated as Equation 7. Processing of the flow marker peak is done via the PolymerChar GPCOne™ Software.

$$Flowrate_{effective} = Flowrate_{nominal} \times \frac{FlowMarker_{Calibration}}{FlowMarker_{Observed}} \quad \text{(EQ7)}$$

Young's Modulus & 2% Secant Modulus

Young's modulus & 2% secant modulus is measured according to ISO 527-3.

Tensile Energy

Tensile energy is measured on an Instron Machine according to ASTM 527-3.

EXAMPLES

The embodiments described herein may be further illustrated by the following non-limiting examples.

Preparation of Inventive Resin 1

A Ziegler-Natta catalyst composition including a magnesium and titanium containing procatalyst and a cocatalyst was used. The procatalyst is a titanium supported $MgCl_2$ Ziegler Natta catalyst. The cocatalyst is triethylaluminum. The procatalyst may have a Ti:Mg ratio between 1.0:40 to 5.0:40. The procatalyst and the cocatalyst components can be contacted either before entering the reactor or in the reactor. The procatalyst may, for example, be any other titanium-based Ziegler Natta catalyst. The Al:Ti molar ratio of cocatalyst component to procatalyst component can be from about 1:1 to about 5:1.

Inventive resin 1 was prepared as follows: the resin is produced using a catalyst system comprising a Ziegler Natta catalyst characterized by a Mg:Ti molar ratio of 40:3.0, and a cocatalyst, 2.5% triethylaluminum (TEAL), in a solution polymerization process. The Al:Ti molar ratio of cocatalyst component to procatalyst component is 3.65:1. Ethylene (C2) and 1-octene (C8) were polymerized in a single loop reactor at a temperature of 190 Celsius and a pressure of 51.7 bar gauge. Polymerization was initiated in the reactor by continuously feeding the catalyst slurry and cocatalyst solution (trialkyl aluminum, specifically tri ethyl aluminum or TEAL) into a solution loop reactor, together with ethylene, hydrogen, 1-octene, and recycle solvent (containing all the unreacted components). The solution of the produced polymer in solvent and unreacted monomers was continuously removed from the reactor and catalyst was deactivated and neutralized before the polymer was separated from all the other compounds in 2 consecutive flash tanks. The separated solvent and unreacted compounds were recycled back to the reactor.

TABLE 1

Inventive & Comparative Resin Properties

| | Density (g/cc) | Melt Index, $I_{2.16}$ (g/10 min) | $I_{10}$ (g/10 min) | $I_{10}/I_{2.16}$ |
|---|---|---|---|---|
| Inventive Resin 1 | 0.950 | 1.5 | 11.5 | 7.8 |
| DOWLEX ™ 2740G, available from The Dow Chemical Company (Midland, MI) | 0.940 | 1.0 | 7.7 | 7.7 |
| ELITE ™ 5940 ST, available from The Dow Chemical Company (Midland, MI) | 0.941 | 0.8 | 9.6 | 12 |

TABLE 2

Inventive & Comparative Resin GPC Properties

| | Mw (g/mol) | Mn (g/mol) | MWD ($M_w/M_n$) |
|---|---|---|---|
| Inventive Resin 1 | 103,600 | 28,000 | 3.7 |
| DOWLEX ™ 2740G, available from The Dow Chemical Company (Midland, MI) | 110,980 | 28,652 | 3.87 |
| ELITE ™ 5940 ST, available from The Dow Chemical Company (Midland, MI) | 97,691 | 14,650 | 6.67 |

These resins were extruded into a 50 micron film using a monolayer Covex extruder having a 45 mm diameter extruder with a length to diameter ratio of 38. The die gap was 1.5 mm and the film was blown to a blow-up-ratio (BUR) of 2.0. The output of the film was of 30 Kg/h. The films were later stretched in the machine direction on a Collin Stretch Line with stretch ratios of 1:4 to 1:7. The temperature of the oven was 110° C. The films were measured for young's modulus, 2% secant modulus, and tensile energy. Tables 3 & 4 below show the results.

TABLE 3

Modulus Data

| | | units | Stretch ratio 0 | 1:4 | 1:5 | 1:6 | 1:7 |
|---|---|---|---|---|---|---|---|
| Inv. Resin 1 Film | Young Modulus | MPa | 827.74 | 2126.1 | 2584.5 | 3105.2 | 3378.7 |
| | 2% Secant Modulus | MPa | 491.09 | 1303.7 | 1632 | 1990.9 | 2161.6 |
| | Thickness | μm | 50.8 | 22.5 | 22.2 | 17.5 | 16.1 |
| DOWLEX ™ 2740G Film | Young Modulus | MPa | 667.14 | 1318.2 | 1800.2 | 2392.1 | 2850.2 |
| | 2% Secant Modulus | MPa | 364.65 | 796.96 | 1150.1 | 1574.8 | 1901.3 |
| | Thickness | μm | 49.9 | 25.9 | 21.6 | 17.1 | 16.6 |
| ELITE ™ 5940 ST Film | Young Modulus | MPa | 669.14 | 974.22 | 1585.6 | 2474.7 | 3673.8 |
| | 2% Secant Modulus | MPa | 378.79 | 555.89 | 1078.7 | 1718.3 | 2541.7 |
| | Thickness | μm | 50.1 | 31.8 | 25.1 | 20.6 | 17.4 |

TABLE 4

Tensile Energy Data

| Stretch ratio | Inventive Resin 1 Film | DOWLEX ™ 2740G Film | ELITE ™ 5940 ST Film |
|---|---|---|---|
| 1:4 | 2.51 Joules | 2.95 Joules | 2.91 Joules |
| 1:5 | 2.09 Joules | 2.07 Joules | 1.43 Joules |
| 1:6 | 1.85 Joules | 1.45 Joules | 0.82 Joules |
| 1:7 | 1.34 Joules | 0.75 Joules | 0.57 Joules |

As shown in Tables 3 and 4, the inventive resin 1 film has a young's modulus above 2,500 MPa at a stretch ratio of 1:5, and has a tensile energy above 1 Joule at the same stretch ratio. The inventive resin also exhibits, at a stretch ratio of 1:7, a young's modulus above 3,000 MPa, while still being able to maintain a tensile energy above 1 Joule at the same stretch ratio.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, if any, including any cross-referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A polyethylene tape, fiber, or monofilament comprising an ethylene/alpha-olefin polymer having:

at least 80 percent of units derived from ethylene;

a density greater than 0.945 g/cc to 0.965 g/cc;

a melt index, $I_{2.16}$, from 1.2 g/10 min to 2.0 g/10 min;

a melt flow ratio, $I_{10}/I_{2.16}$, between 7.0 and 9.0; and a molecular weight distribution, Mw/Mn, of less than 5.5;

wherein when the tape, fiber or monofilament is machine direction oriented at a stretch ratio of at least 1:5, the tape exhibits the following properties:

a young's modulus, as measured according to EN ISO 527-3, of greater than 2,500 MPa; and a tensile energy, as measured according to EN ISO 527-3, of greater than 1.0 Joules; and wherein the polyethylene tape, fiber, or monofilament refers to a tape, fiber, or monofilament that is made from 100% polyethylene out of the total polymer content.

2. The tape, fiber or monofilament of claim 1, wherein the alpha-olefin comonomer is a $C_4$-$C_{10}$ alpha-olefin.

3. The tape, fiber or monofilament of claim 2, wherein the alpha-olefin comonomer is selected from the group consisting of butene, hexene, and octene.

4. The tape, fiber or monofilament of claim 1, wherein the ethylene/alpha-olefin polymer has a unimodal molecular weight distribution as determined by gel permeation chromatography.

5. The tape, fiber or monofilament of claim 1, wherein the ethylene/alpha-olefin polymer is made in the presence of one or more Ziegler-Natta catalyst systems.

6. The tape, fiber or monofilament of claim 1, wherein the ethylene/alpha-olefin polymer is made in a solution reactor.

* * * * *